US005837915A

United States Patent [19]

Suenaga

[11] Patent Number: 5,837,915

[45] Date of Patent: Nov. 17, 1998

[54] ELECTRONIC DRUM HAVING FLAT SOUND PRODUCING CHARACTERISTICS

[75] Inventor: Yuichiro Suenaga, Shizuoka, Japan

[73] Assignee: Yamaha Corporation, Japan

[21] Appl. No.: 816,062

[22] Filed: Mar. 11, 1997

[30] Foreign Application Priority Data

Mar. 12, 1996 [JP] Japan ..... 8-054700

[51] Int. Cl.[6] ..... G10H 1/057; G10H 3/14

[52] U.S. Cl. ..... 84/738; 84/DIG. 12

[58] Field of Search ..... 84/723, 725, 730, 84/733, 734, 738, DIG. 12, DIG. 24

[56] References Cited

U.S. PATENT DOCUMENTS

| | | | |
|---|---|---|---|
| 4,581,973 | 4/1986 | Hoshino | 84/DIG. 12 |
| 4,669,349 | 6/1987 | Hyakutake | 84/DIG. 24 |
| 4,679,479 | 7/1987 | Koyamoto | 84/DIG. 24 |
| 4,947,725 | 8/1990 | Nomura | 84/730 X |
| 5,293,000 | 3/1994 | Adinolfi | 84/730 |
| 5,396,024 | 3/1995 | Noguchi et al. | 84/730 |

*Primary Examiner*—Stanley J. Witkowski
*Attorney, Agent, or Firm*—Ostrolenk, Faber, Gerb & Soffen, LLP

[57] ABSTRACT

An electronic drum has a drum pad beaten with sticks and a pad structure, a sensor board attached to the pad structure and an piezoelectric element attached to the sensor board form in combination the drum pad; the sensor board is formed of cellular vinyl chloride with an internal loss or tangent-delta equal to or greater than 0.02 so that the vibrations propagated to the sensor board have a constant amplitude.

6 Claims, 5 Drawing Sheets

ELECTRONIC DRUM HAVING FLAT SOUND PRODUCING CHARACTERISTICS

FIELD OF THE INVENTION

This invention relates to an electronic musical instrument and, more particularly, to an electronic drum beaten for generating an electronic drum sound.

DESCRIPTION OF THE RELATED ART

There are many kinds of electronic musical instrument. An electronic keyboard and a synthesizer are typical examples of the electronic musical instrument. Electronic drums have been developed, and are used by a drum player. An electronic drum has a drum pad struck with a stick, and sensors are attached to a back surface of the drum pad. The sensor is implemented by piezoelectric element, and converts an impact to an electric signal. The electric signal is representative of the strength of the impact, and an electronic drum sound is produced from the electric signal.

FIGS. 1 and 2 illustrates a prior art electronic drum. The prior art electronic drum 1 comprises a drum pad 1*a* and an electronic sound generating system (not shown) connected to the drum pad 1*a*. The drum pad 1*a* includes a supporting member 1*b* formed of iron and a pad member 1*c* formed of rubber. Both of the supporting member 1*b* and the pad member 1*c* are shaped into a disk configuration, and are equal in diameter to each other. The pad member 1*c* is laminated on the supporting member 1*b*, and is fixed thereto.

The prior art drum pad 1*a* further includes an absorbing member 1*d* attached to the back surface of the supporting member 1*d* and a piezoelectric element 1*e* fixed to the back surface of the absorbing member 1*d*. The absorbing member 1*d* is formed of sponge, and both surfaces of the sponge layer is coated with adhesive compound. The adhesive compound integrates absorbing member 1*d*, the piezoelectric element le and the supporting member 1*d*. The absorbing member 1*d* has a disk configuration much smaller than the supporting member 1*b*, and the piezoelectric element 1*e* also has a disk configuration slightly smaller than the absorbing member 1*d*. For this reason, only a central area of the supporting member 1*b* is covered with the absorbing member 1*d*, and most of the absorbing member 1*d* is covered with the piezoelectric element 1*e*.

When a drum player beats the top surface of the pad member 1*c*, vibrations take place, and the supporting member 1*b* and the absorbing member 1*d* propagate the vibrations to the piezoelectric element 1*e*. The piezoelectric element 1*e* converts the vibrations to an electric signal, and a lead wire 1*f* transfers the electric signal from the piezoelectric element 1*e* to the electronic sound generating system. The electronic sound generating system is responsive to the electric signal so as to generate an electronic drum sound.

The vibrations gradually decrease the amplitude thereof in proportional to the distance between a point beaten with the stick and the piezoelectric element 1*e*, and the amplitude of the electric signal is proportional to the amplitude of the vibrations. For this reason, when the drum player beats different points on the pad member 1*c*, the amplitude of the electric signal is decreased in inverse proportion to the distance between the point beaten with the stick and the piezoelectric element 1*e* as shown in FIG. 3. When the drum player beats the central area over the piezoelectric element 1*e*, the amplitude of the electric signal is maximized. On the other hand, a beat in the peripheral area results in the minimum amplitude of the electric signal. The electronic sound generating system determines the loudness of the electronic sound depending upon the amplitude of the electric signal. This means that the electronic drum sound is variable in loudness with the point beaten with the stick. However, such a variable drum sound is hardly controlled by the drum player, because he is expected to exactly control the stick in not only the strength of the stick but also the point beaten therewith.

In order to improve the sound generation characteristics of the prior art electronic drum, the piezoelectric element 1*e* is mounted on a sensor board 2*a* as shown in FIGS. 4 and 5. In detail, the drum pad 2 of the prior art electronic drum 1 includes the supporting member 1*b*, the pad member 1*c* and the piezoelectric element 1*e* as similar to the drum pad 1*a*, and the piezoelectric element 1*e* is attached to a central area of the rectangular sensor board 2*a* formed of synthetic resin. The absorbing member 1*d* is divided into a plurality of absorbing sub-members 2*b*, and the absorbing sub-members 2*b* attach the sensor board 2*a* to the supporting member 1*b*.

The sensor board 2*a* is wider than the piezoelectric element 1*e*, and changes the output characteristics as shown in FIG. 6. It is understood from FIG. 6 that the sensor board 2*a* makes the output characteristics mild. Even if a drum player beats the intermediate area between the central area and the peripheral area of the pad member 1*c*, the electronic drum sound is fairly equal in intensity to the sound at the impact in the central area. However, there are three peaks in the output characteristics, and the sensor board 2*a* steeply slopes the output characteristics from the intermediate area to the peripheral area. Thus, the prior art drum pad 2 still does not satisfy a drum player. The variation of the electric signal due to the different beaten points is hereinbelow referred to as "local dependency".

SUMMARY OF THE INVENTION

It is therefore an important object of the present invention to provide an electronic drum which generates drum sounds equal in loudness regardless of a point beaten by a player.

The present inventor contemplated the problem inherent in the prior art electronic drum, and noticed that the sensor board was formed of synthetic resin. The synthetic resin was small in internal loss, which was usually represented by "tangent delta" or "loss tangent", and large in resonance sharpness. For this reason, when the present inventor beat the prior art drum pad 2, the nodes and the anti-nodes clearly took place in the sensor board 2*a*. The present inventor further observed that the waveform of the vibrations was varied depending upon the point beaten with a stick and the location of the absorbing sub-members 2*b*. This meant that the detected point on the waveform was variable with the point beaten with the stick. The present inventor concluded that an appropriate sensor board would improve the sound producing characteristics of the electronic drum.

To accomplish the object, the present invention proposes to form a sensor board of a material with a large internal loss.

In accordance with the present invention, there is provided an electronic drum comprising: a pad structure having a surface beaten by a player so as to generate vibrations therein; a sensor unit including a sensor board formed of a material having an internal loss equal to or greater than 0.02 and a vibration sensor attached to the sensor board so as to convert the vibrations to an electric signal; a vibration absorbing member provided between the pad structure and the sensor unit for propagating the vibrations to the sensor board; and an electric sound generating system connected to the vibration sensor for producing an electric drum sound on the basis of the electric signal.

BRIEF DESCRIPTION OF THE DRAWINGS

The features an advantages of the electronic drum according to the present invention will be more clearly understood from the following description taken in conjunction with the accompanying drawings in which.

DESCRIPTION OF THE PREFERRED EMBODIMENT

Figure 1:
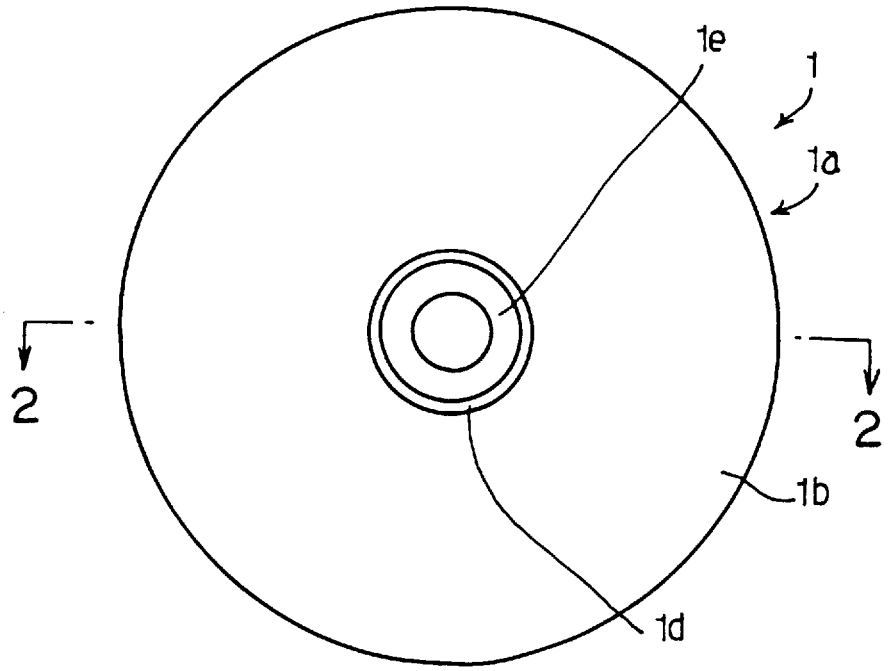
Fig. 1 PRIOR ART
FIG. 1 is a bottom view showing the prior art electronic drum.
Figure 2:
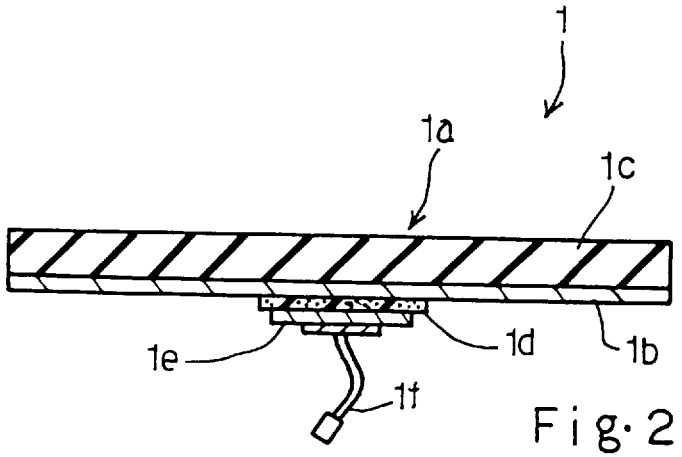
Fig. 2 PRIOR ART
FIG. 2 is a cross sectional view taken along line 2—2 of FIG. 1 and showing the structure of the prior art electronic drum.
Figure 3:
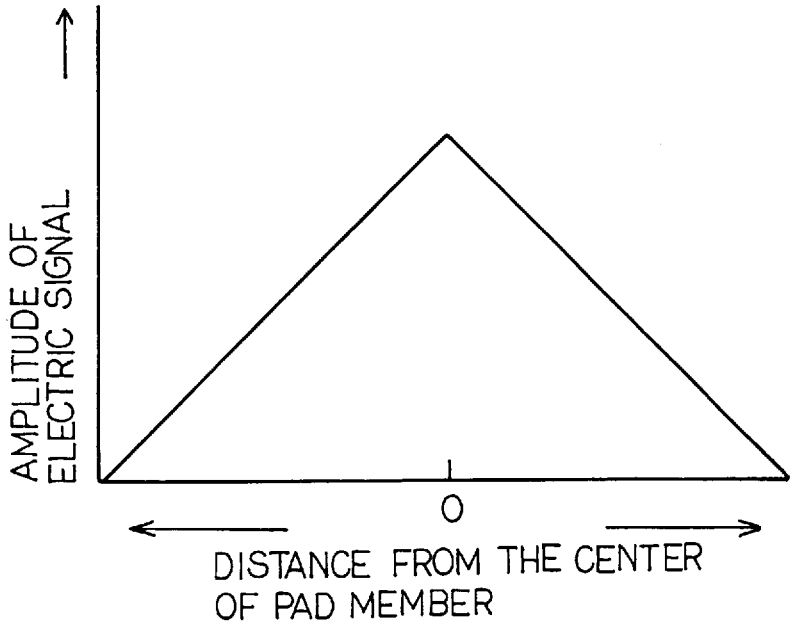
Fig. 3 PRIOR ART
FIG. 3 is a graph showing the amplitude of the electric signal in terms of the point beaten with the stick.
Figure 6:
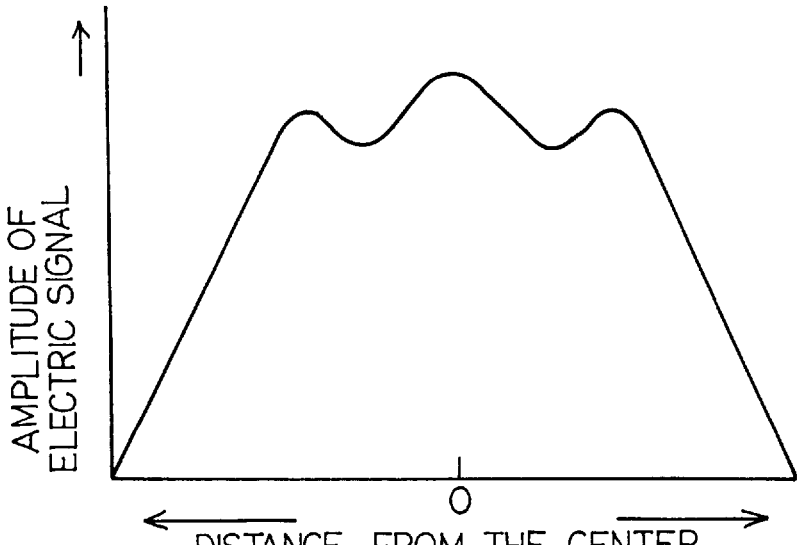
Fig. 6 PRIOR ART
FIG. 6 is a graph showing the amplitude of the electric signal generated by the prior art electronic drum shown in FIG. 4 in terms of the point beaten with the stick.
Figure 4:
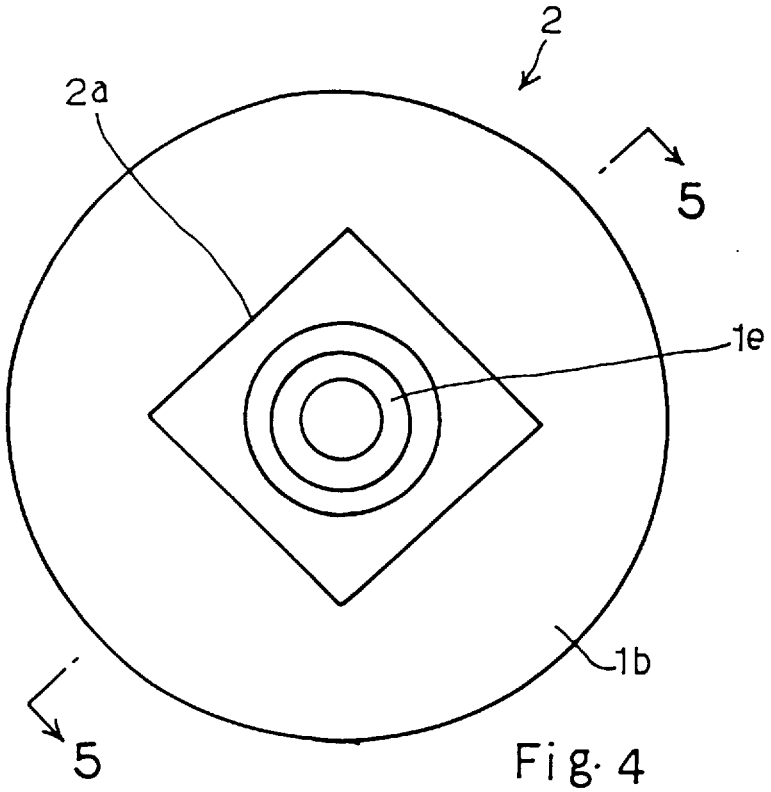
Fig. 4 PRIOR ART
FIG. 4 is a bottom view showing another prior art electronic drum.
Figure 5:
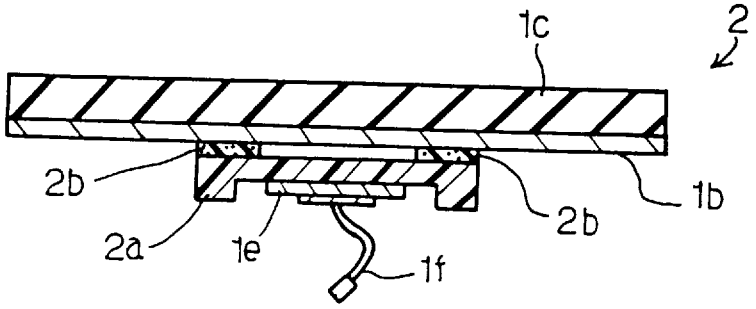
Fig. 5 PRIOR ART
FIG. 5 is a cross sectional view taken along line 5—5 of FIG. 4 and showing the structure of the prior art electric drum.
Figure 7:
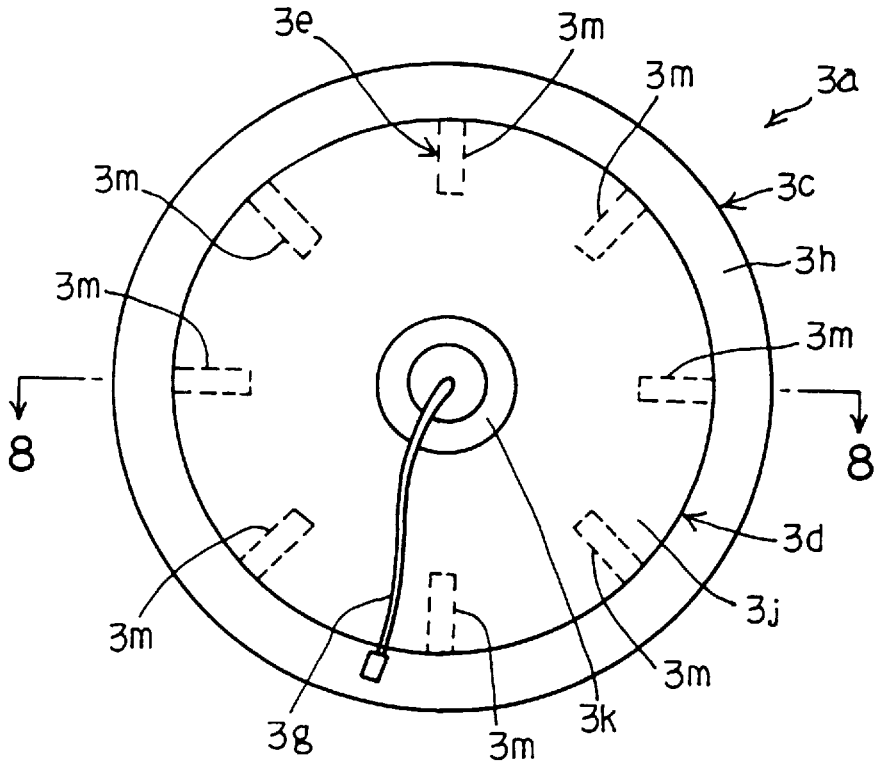
FIG. 7 is a bottom view showing an electronic drum according to the present invention.
Figure 8:
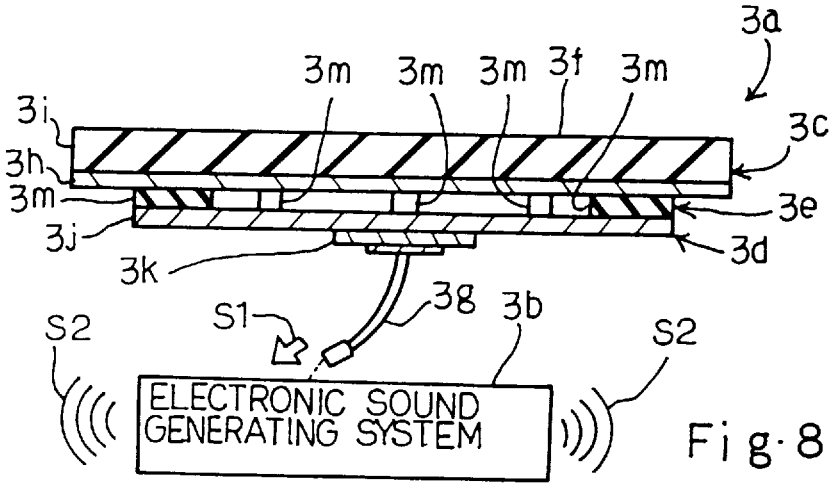
FIG. 8 is a cross sectional view taken along line 8—8 of FIG. 7 and showing the structure of the electronic drum.

Referring to FIGS. 7 and 8 of the drawings, an electronic drum embodying the present invention largely comprises a drum pad 3*a* and an electronic sound generating system 3*b* connected to the drum pad 3*a*.

The electronic sound generating system 3*b* is similar to that of the prior art electronic drum. An electric signal S1 is supplied from the drum pad 3*a* to the electronic sound generating system 3*b*, and the electronic sound generating system 3*b* generates an electronic drum sound S2 on the basis of the electric signal S1.

The drum pad 3*a* is broken down into a pad structure 3*c* beaten with sticks (not shown), a vibration sensor unit 3*d* for generating the electric signal S1 and a vibration absorbing member 3*e* provided between the pad structure 3*c* and the vibration sensor unit 3*d*. When a drum player beats the upper surface 3*f* of the pad structure 3*c*, vibrations take place in the pad structure 3*c*, and are propagated from the pad structure 3*c* through the vibration absorbing member 3*e* to the vibration sensor unit 3*d*. The vibration sensor unit 3*d* converts the vibrations to the electric signal S1, and the electric signal S1 is transferred from the vibration sensor unit 3*d* through a signal wire 3*g* to the electronic sound generating system 3*b*.

A supporting member 3*h* and a pad member 3*i* form in combination the pad structure 3*c*. The supporting member 3*h* is formed of iron, and is shaped into a disk configuration. The pad member 3*i* is formed of natural rubber, synthetic rubber or a mixture thereof, and is also formed into a disk configuration. The pad member 3*i* is equal in diameter to the supporting member 3*h*, and is thicker than the supporting member 3*h*. The pad member 3*i* is laminated on the supporting member 3*h*, and is fixed thereto by means of adhesive compound.

The vibration sensor unit 3*d* includes a sensor board 3*j* and a piezoelectric element 3*k* connected to the signal wiring 3*g*. In this instance, the sensor board 3*j* is formed of cellular vinyl chloride. The sensor board 3*j* is shaped into a disk configuration, and is approximately equal in thickness to the supporting member 3*h*. Although the sensor board 3*j* is slightly smaller in diameter than the supporting member 3*h*, the sensor board 3*j* and the supporting member 3*h* are cocentric with each other, and the sensor board 3*j* is attached to the supporting member 3*h* by means of the vibration absorbing member 3*e*.

Figure 9:
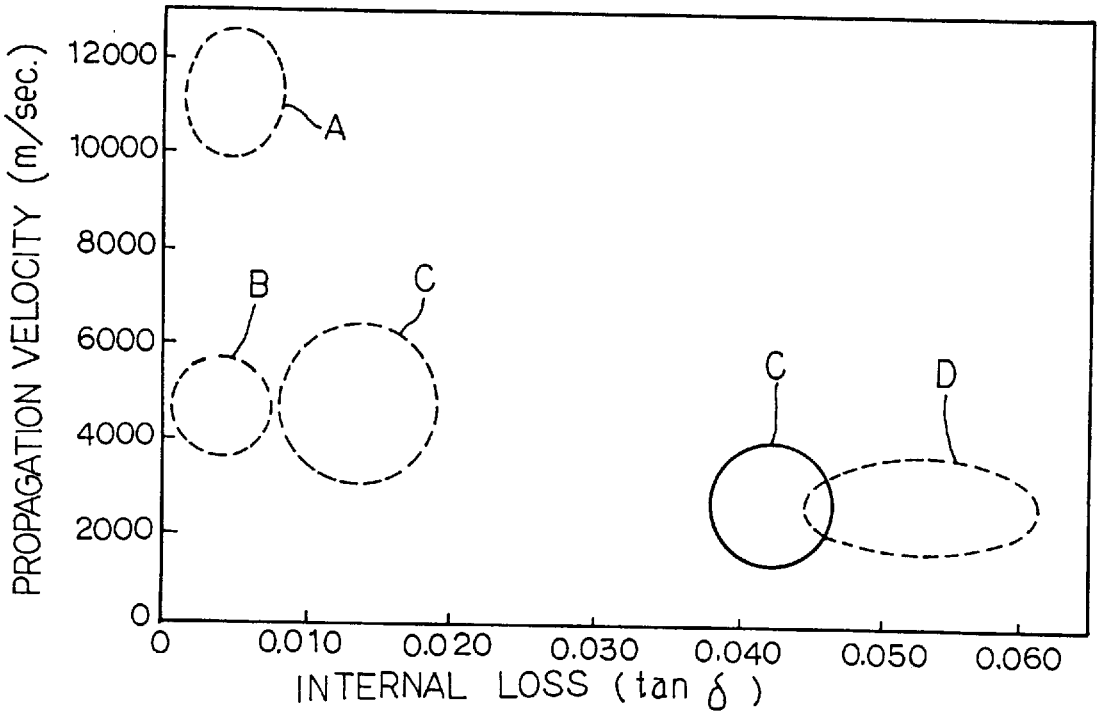
FIG. 9 is a graph showing a relation between an internal loss, a propagation velocity and the material of a medium.

Other material is available for the sensor board 3*j* in so far as the internal loss, i.e., tangent delta is equal to or greater than 0.02 which is the internal loss of a typical synthetic resin already used for the prior art sensor board 2*a*. Although paper has the tangent delta greater than 0.02, the durability is poor. FIG. 9 illustrates the internal loss and the propagation velocity for vibrations. Regions A, B, C and D respectively stand for ceramics such as, for example, beryllia ceramics, silicones and alumina, light metal such as, for example, aluminum, titanium and magnesium, synthetic resin such as fiber-reinforced plastic resin, cellular vinyl chloride and paper including pulp.

The sensor board 3*j* formed of material with the internal loss equal to or greater than 0.02 make the vibrations uniform, and, accordingly, makes the amplitude of vibrations constant over the sensor board 3*j*. For this reason, even if the vibrations are propagated from any point on the top surface 3*f* to the sensor board 3*j*, the piezoelectric element 3*k* generates the electric signal S1 with a constant amplitude in so far as the drum player beats the top surface 3*f* at a constant impact. Thus, the sensor board 3*j* eliminates the local dependency of the drum sound, and, accordingly, allows a drum player to generate the electronic drum sound at a constant loudness regardless of the point beaten with the stick.

The uniform vibration property allows the manufacturer to enlarge the sensor board 3*j*, and the large sensor board 3*j* further eliminates the local dependency, because the vibrations immediately reach the sensor board 3*j*.

The piezoelectric element 3*k* detects vibrations propagated from the pad structure 3*c* through the vibration absorbing member 3*e* thereto. The vibrations give a strain to the piezoelectric element 3*k*, and the piezoelectric element 3*k* generates electric potential proportional to the strain. The variation of the electric potential is detected as the electric signal S1.

A plurality of vibration absorbing strips 3*m* form in combination the vibration absorbing member 3*e*, and are shaped into a rectangular configuration. In this instance, eight vibration absorbing strips 3*m* are radially arranged, and are equally spaced from one another along the outer periphery of the sensor board 3*j*. This means that the vibration absorbing strips 3*m* are angularly arranged at a constant pitch. The vibration absorbing strips 3*m* are formed of buthyle rubber, and have an appropriate thickness so as to achieve a good balance between the damping characteristics and the vibration propagation characteristics. The vibration absorbing strips 3*m* are coated with adhesive compound on both surfaces thereof, and adhere the sensor board 3*j* to the supporting member 3*h*.

The vibration absorbing strips 3*m* thus arranged cause the vibrations to enter into the periphery of the sensor board 3*j*, and smoothly transfer the vibrations from the supporting member 3*h* to the sensor board 3*j*. Even if a drum player beats a central area of the surface 3*f*, the vibrations radially spread over the pad structure 3*c*, and the vibration absorbing strips 3*m* transfer the vibrations from the periphery of the pad structure 3*c* to the periphery of the sensor board 3*j*. The sensor board 3*j* propagates the vibrations from the periphery thereof to the piezoelectric element 3*k* at the central area. The disk configuration of the sensor board 3*j* also promotes the elimination of the local dependency, because the vibrations travels over a constant distance between beaten points on the same circumference and the vibration absorbing strips 3*m*. Thus, the vibration absorbing strips 3*m* and the disk configurations equalize the distance between the beaten points and the piezoelectric element 3*k*, and effectively eliminate the local dependency. Especially, when a central area of the surface 3*f* is beaten, the vibration absorbing strips 3*m* improve a vibration transmission response. The improvement of the vibration transmission response means that the vibrations are propagated at high speed.

It is desirable for the sensor board 3*j* to have the following damping characteristics so as to cause the piezoelectric element 3*k* to generate the electric signal S1 with a constant amplitude. The desirable damping characteristics cause the first wave of the vibrations to have a large amplitude in the dead range or the maximum detectable range and the second wave to rapidly enter through the dead range into the non-detectable range, or damp the first wave to the nth wave in the dead range and the (n+1)th wave, the (n+2)th wave, . . . in the non-detectable range. Such a damping characteristics is achieved by selecting the material and the configuration of the sensor board 3*j*, the material and the configuration of the vibration absorbing strips 3*m* and the relative relation of dimensions between the sensor board 3*j* and the vibration absorbing strips 3*m*. The cellular vinyl chloride, the buthyle rubber and the disk configuration are the most appropriate materials for the sensor board 3*j* and the vibration absorbing strips 3*m*.

The term "non-detectable range" is defined as a time period when a tone generator supplies an audio signal to a speaker system in response to a potential signal higher than the threshold (or the lower limit of the potential level for the tone generator). Even if the next wave higher in potential level than the threshold reaches the tone generator in the non-detectable range, the tone generator can not respond to the next wave.

The most appropriate arrangement of the vibration absorbing strips 3*m* is shown in FIG. 7. Namely, the vibration absorbing strips 3*m* are spaced from the center of the sensor board 3*j* as far as possible, and are arranged in such a manner as to form a circle cocentric with respect to the disk-shaped sensor board 3*j*. The vibration absorbing strips 3*m* are spaced from each other at a constant pitch.

The relative relation between the vibration absorbing strips 3*m* and the sensor board 3*j* falls within the following range:

i) the diameter of the sensor board 3*j* ranges from 50% to 100% of the diameter of the circle of the vibration absorbing strips 3*m;* ii) the thickness of the supporting member 3*h* ranges from 10% to 50% of the thickness of the pad member 3*i;* iii) the thickness of the vibration absorbing strips 3*m* ranges from 10% to 50% of the thickness of the pad member 3*i;* iv) the thickness of the sensor board 3*j* ranges from 10% to 50% of the thickness of the pad member 3*i*; and v) the internal loss or tangent-delta is equal to or greater than 0.02.

In the above described embodiment, the pad member 3*i* has the diameter of 179.6 millimeters, and is 6 millimeters in thickness; the supporting member 3*h* has the diameter of 152.8 millimeters, and is 1.6 millimeters in thickness; the vibration absorbing strips 3*m* are 20 millimeters in length, 5 millimeters in width and 1 millimeter in thickness; the sensor board 3*j* has the diameter of 110 millimeters, and is 1 millimeter in thickness; and the internal loss or the tangent-delta is 0.04.

Figure 10:
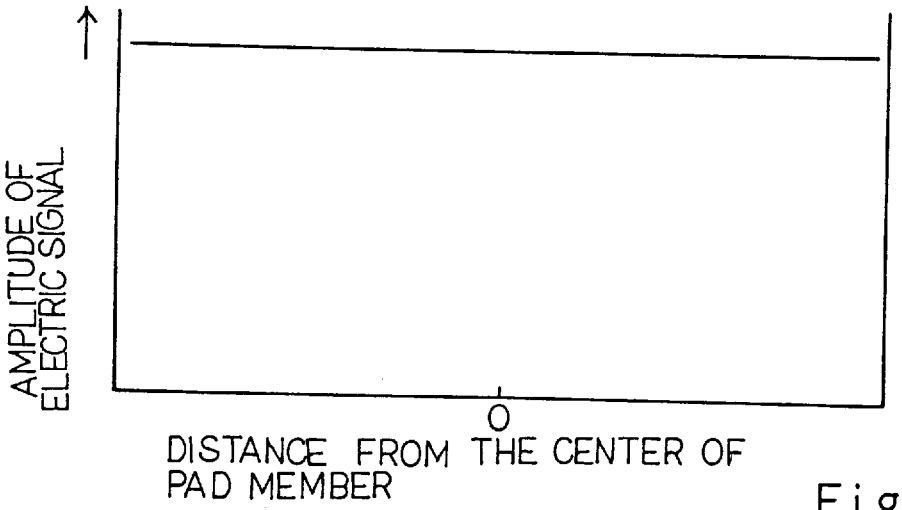
FIG. 10 is a graph showing the amplitude of the electric signal generated by the electronic drum shown in FIG. 7 in terms of the point beaten with the stick.

The present inventor evaluated the drum pad 3*a* in comparison with a comparative example which had a sensor board with the internal loss less than 0.02. The present inventor beat the surface 3*f* with a stick at a constant impact, and changed the point beaten with the stick over the surface 3*f* so as to plot the amplitude of the electric signal S1 in terms of the distance from the center of the pad member 3*i*. The amplitude of the electric signal S1 was substantially constant as shown in FIG. 10; however, the constant amplitude was never observed in the comparative example. A flat output characteristics of the piezoelectric element 3*k* were observed in so far as the relative dimensions between the sensor board 3*j* and the vibration absorbing strips 3*m* fell within the above described ranges.

As will be appreciated from the foregoing description, the sensor board 3*j* with the internal loss not less than 0.02 equalizes the amplitude of the vibrations propagated therethrough, and effectively eliminates the local dependency. As a result, the electronic drum according to the present invention generates the electronic drum sound at a constant loudness in so far as a drum player beats the drum pad 3*a* at a constant impact.

Although particular embodiments of the present invention have been shown and described, it will be obvious to those skilled in the art that various changes and modifications may be made without departing from the spirit and scope of the present invention.

For example, an electronic drum according to the present invention may be beaten with hands or mallets.

The sensor board 3*j* may be shaped into a polygonal configuration closed to a circle.

The vibration absorbing member 3*e* may have a ring configuration.

The pad structure may be constituted by a supporting member sandwiched between pad members or a pad member formed of hard rubber.

The electronic sound generating system may impart a timbre different from a drum sound to the electronic sound or simply amplitude the electric signal.

The sensor board 3*j* may be formed of a material having the internal loss not less than 0.02 and a vibration propagation velocity larger than the cellular vinyl chloride. The material improve the vibration transmittability of the sensor board.

What is claimed is:

1. An electronic drum comprising:

a pad structure having a surface beaten by a player so as to generate vibrations therein;

a sensor unit including a sensor board formed of a material having a tangent delta representative of internal loss equal to or greater than 0.02 and a vibration sensor attached to said sensor board so as to convert said vibrations to an electric signal;

a vibration absorbing member provided between said pad structure and said sensor unit for propagating said vibrations to said sensor board; and an electric sound generating system connected to said vibration sensor for producing an electric drum sound on the basis of said electric signal.

2. The electronic drum as set forth in claim 1, in which said sensor board is shaped into a disk configuration, and the center of said senor board is aligned with a center of said pad structure.

3. The electronic drum as set forth in claim 2, in which said vibration sensor is attached to said center of said sensor board, a plurality of vibration absorbing strips form in combination said vibration absorbing member, and said plurality of vibration absorbing strips are arranged between a peripheral area of said sensor board and said pad structure at a constant pitch and form a virtual ring cocentric with said sensor board.

4. The electronic drum as set forth in claim 3, in which each of said plurality of vibration absorbing strips has rectangular contact surfaces attached to said peripheral area of said sensor board and said pad structure, and said rectangular contact surfaces have longitudinal directions aligned with radial direction of said sensor board.

5. The electronic drum as set forth in claim 1, in which said sensor board is formed of cellular vinyl chloride.

6. The electronic drum as set forth in claim 1, in which said sensor board and said vibration absorbing member are respectively formed of cellular vinyl chloride and buthyle rubber.

* * * * *